US006000576A

United States Patent [19]

Liu

[11] Patent Number: 6,000,576

[45] Date of Patent: Dec. 14, 1999

[54] STRUCTURE FOR COVERED STORAGE BINS

[76] Inventor: Ching-Rong Liu, No. 10, Sung-Chiang N. Road, Chung-Li City, Taiwan

[21] Appl. No.: 09/113,327

[22] Filed: Jul. 10, 1998

[51] Int. Cl.[6] ..... B65D 43/14

[52] U.S. Cl. ..... 220/826; 220/844; 206/508

[58] Field of Search ..... 220/826, 833, 220/843, 844; 206/508

[56] References Cited

U.S. PATENT DOCUMENTS

| | | | |
|---|---|---|---|
| 3,463,345 | 8/1969 | Bockestette | 220/826 |
| 4,161,261 | 7/1979 | Frater | 220/826 |
| 4,364,489 | 12/1982 | Alexeeff | 220/826 |
| 4,432,467 | 2/1984 | Swingley, Jr. | 220/826 |
| 4,620,644 | 11/1986 | Miller | 220/826 |
| 4,765,480 | 8/1988 | Malmanger | 220/826 X |
| 4,892,221 | 1/1990 | Gora et al. | 220/826 |
| 5,328,048 | 7/1994 | Stein | 220/826 |
| 5,330,069 | 7/1994 | Jamison et al. | 220/826 X |
| 5,353,948 | 10/1994 | Lanoue et al. | 220/826 |

*Primary Examiner*—Stephen K. Cronin
*Attorney, Agent, or Firm*—Bacon & Thomas

[57] ABSTRACT

A storage bin and a top lid are temporarily locked for sealing, the storage bin is provided on tops of two opposite sides thereof with several pivot seats, notches are provided each between every two of the pivot seats, the storage bin has several through holes and receiving grooves; the top lid is divided into two halves and is provided on one side of each half with pivot seats, the two halves are pivotably connected with the storage bin by means of axle holes provided on the aforesaid pivot seats and two axles, and have thereon several transverse limiting protrusions, longitudinal limiting protrusions and limiting blocks which together form a limiting area, one side of each half has protruding engaging portions and recessed engaging portions mutually alternately arranged, the protruding engaging portions each has on the bottom thereof an engaging groove, while the recessed engaging portions each has on the top thereof an engaging strip and an engaging block, several round holes on the top lid are exactly located respectivly on several through holes on the storage bin to allow several buckling belts to extend through the round holes and through holes and to buckle.

5 Claims, 8 Drawing Sheets

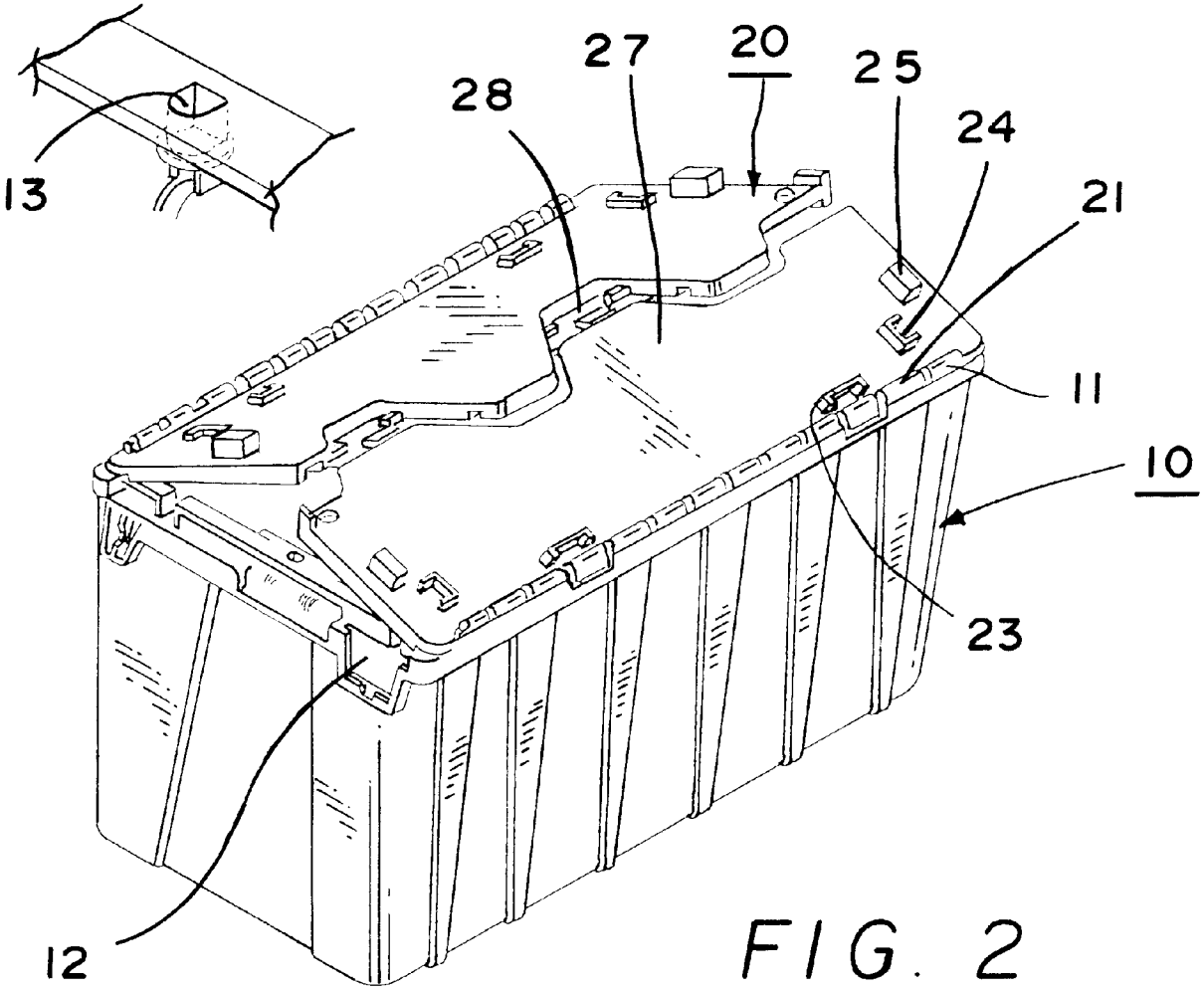
FIG. 2
FIG. 2B
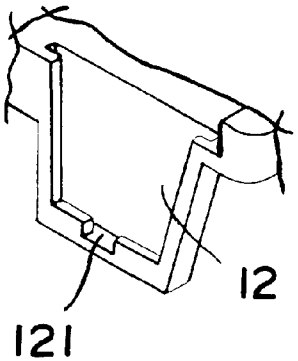
FIG. 2A

STRUCTURE FOR COVERED STORAGE BINS

BACKGROUND OF THE INVENTION

1. Field of the Invention

The present invention relates to an improved structure for covered storage bins, and especially to an improved structure for storage bins wherein storage bins and top lids thereof are temporarily locked for sealing and thus to protect and keep intactness of the articles in the storage bins, to prevent them from dropping during shipping, when the storage bins are loaded with the articles, the top lids are temporarily locked by engagement with the storage bins to well protect the articles in the storage bins, a receiving groove for an indicating tag is provided on each side of each storage bin to show the contents therein, such storage bins thus are distinguishable, safe and convenient.

2. Description of the Prior Art

Storage and shipping for smaller articles normally are done with storage bins for preventing the smaller articles from scattering in a mess and occupying too much space, thereby no necessity is it to move every piece of the articles in strorage and moving, and therefore time is saved and working is easier in transportation, for this reason, use of storage bins are more and more popularized, conventional storage bins (referring to FIG. 1) do not have fixed lids, articles are placed in such storage bins A and moved or stored without lids thereon, however, the articles in these storage bins A are subjected to dropping and hence no adequate safety is endued with, and when in storage, the storage bins A are subjected to incoming of dust and imprurities, so that when the storage bins A are to be used, they must be wiped and cleansed, this is troublesome for workers, and strorage and moving of the storage bins A are so inconvenient that articles and members of a device with higher delicacy or quality are not suitable to be stored or transported in such storage bins A; a user of such storage bins A might use top lids B for temporary covering, the top lids B and the storage bins A do not have any fixing or junction between them, when the storage bins A are moved or when the storage bins A are collided by an external thing, the top lids B may drop; or a worker does not cover the lids B in time after he uncovered the lids B to thereby render the lids B to lose their function of covering the storage bins A; if the storage bins A are tied with ropes after covered with lids B to prevent the lids B from dropping, this may obtain the function of preventing from dropping, however, the storage bins A are heavier after tying, and tying and untying works are quite troublesome and very inconvenient, use of the lids B on the storage bins A seems to be much more bothersome.

SUMMARY OF THE INVENTION

In view that small articles stored in storage bins A can facilitate stacking and arrangement of the small articles, while due to uncovering of the storage bins A, the storage bins A are subjected to incoming of dust and imprurities, so that the stored articles are not totally or perfectly protected, the inventor of the present invention successfully develops the present invention after continuous hard study and improving, and multiple experiments, tests and tries based on his professional experience of years in designing, manufacturing and selling similar products, wherein, a liftable top lid is pivotably provided on a storage bin, the top lid and the storage bin can be temporarily locked with engaging members, so that articles in the storage bin can be protected against dropping out and against incoming of dust and imprurities, so that the storage bin can be moved and stored after placing therein the articles.

The primary object of the present invention is to provide a pivotable and liftable top lid on a storage bin, the top lid includes two mutually symetrical half-lids tightly cross connected with each other which are unable to be loosened, and dust and impurities are unable to fall in the storage bin.

The secondary object of the present invention is to provide a plurality of round holes on the top lid, so that when the top lid covers the storage bin, the round holes are aligned with a plurality of through holes provided on the storage bin, buckling belts can be inserted through the round holes and the through holes to temporarily lock the lid on the storage bin, and thus to prevent the lid from being lifted during transportation of the storage bin, and intactness of the articles in the storage bin can be kept.

Another object of the present invention is to provide a receiving groove for an indicating tag on each of the opposite lateral sides of the storage bin, a notch is provided on the bottom of the receiving groove to prevent water or dirt from deposition in the receiving groove, and for the purpose of cleaning of the receiving groove, the indicating tag can be completely put in the receiving groove; the indicating tag can show the contents in the storage bin, therefore, the storage bin can facilitate classifying and taking out of the articles, it is not necessary to lift the lid to see what are in the storage bin.

The present invention will be apparent in its practical structural characteristics and its way of use after reading the detailed description of the preferred embodiment thereof in reference to the accompanying drawings.

BRIEF DESCRIPTION OF THE DRAWINGS

In the drawings:

FIG. 2 is a perspective view of the present invention;

FIG. 2A is an enlarged perspective view showing a receiving groove for an indicating tag on the storage bin of the present invention;

FIG. 2B is an enlarged perspective view showing a through hole on the storage bin of the present invention;

DETAILED DESCRIPTION OF THE PREFERRED EMBODIMENT

Figure 1:
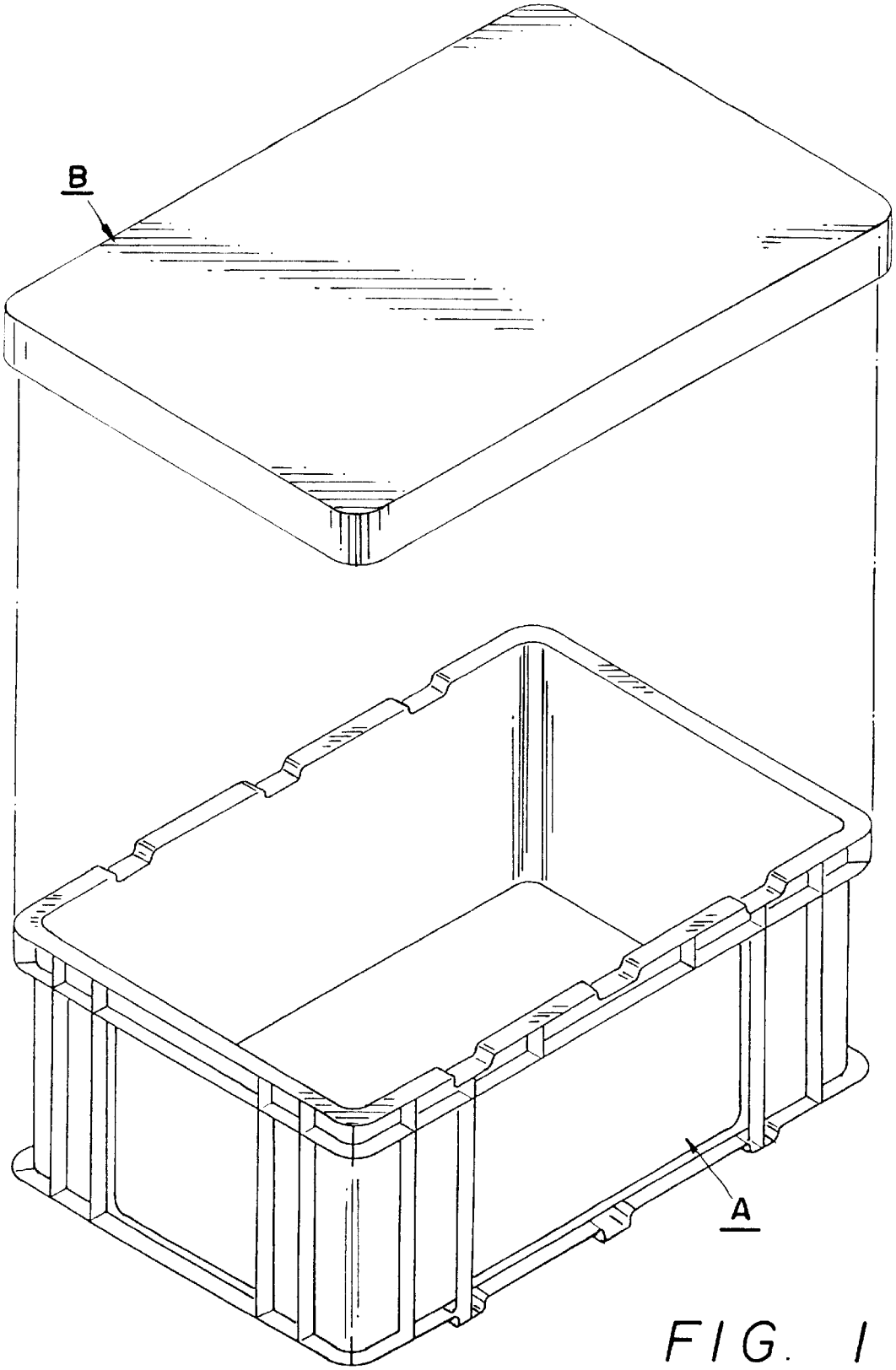
FIG. 1 PRIOR ART
FIG. 1 is a perspective view of a conventional storage bin.
Figure 3:
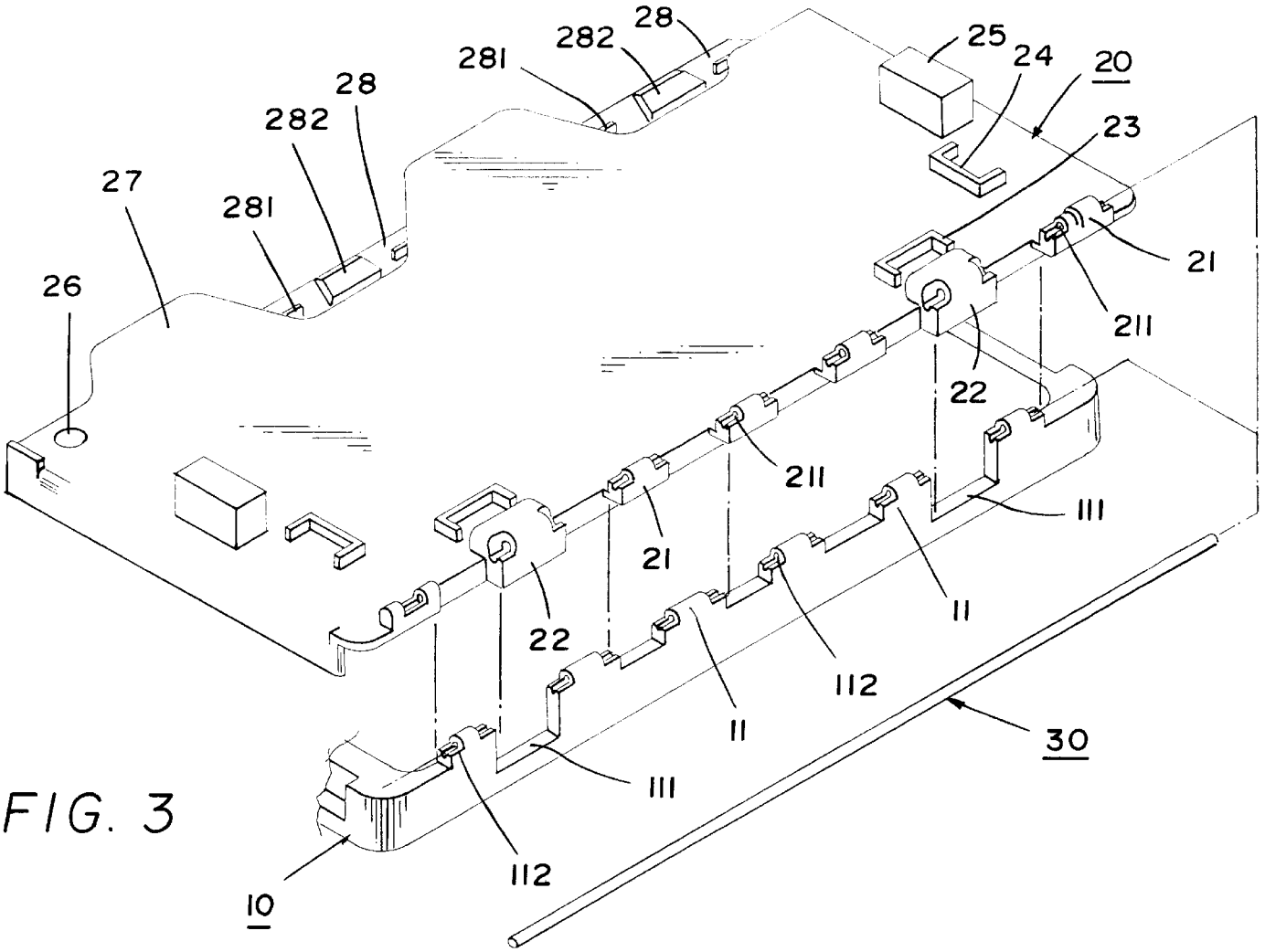
FIG. 3 is an analytic perspective view showing a top lid is pivotably connected on the storage bin of the present invention.

It can be seen from FIGS. 2 and 3 that, the storage bin 10 of the present invention is pivotably provided with a top lid 20 and two pivot axles 30, wherein:

The storage bin 10 is provided on two opposite sides thereof with a plurality of pivot seats 11 which are provided each with an axle hole 112, a plurality of notches 111 are provided each between every two pivot seats 11, the storage bin 10 is provided respectively on each of the two opposite lateral sides thereof with a through hole 13 and a receiving groove 12 (as shown in FIGS. 2A and 2B), a notch 121 is provided on the bottom of the receiving groove 12;

The top lid 20 which is divided into two halves is provided on one side of each half with a plurality of pivot seats 21, a plurality of pivot protuberances 22 are provided between the two pivot seats 21 at both ends of this side, the pivot seats 21 and the pivot protuberances 22 are provided each with an axle hole 211, the other side of each half is provided respectively with a plurality of protruding engaging portions 27 and recessed engaging portions 28 mutually alternately arranged, each protruding engaging portion 27 is provided on the bottom thereof with an engaging groove 271, while each recessed engaging portion 28 is provided on the top thereof with an engaging strip 281 and an engaging block 282, the top lid 20 is provided thereon near the pivot seats 21 with a plurality of transverse limiting protrusions 23 and longitudinal limiting protrusions 24, the top lid 20 is provided also thereon with a plurality of limiting blocks 25.

By providing the above stated members, wherein the two halves of the top lid 20 are pivotably and mutually symetrically provided on the storage bin 10, the pivot seats 21 provided on one side of each half of the top lid 20 are placed alternately relative to the pivot seats 11, the pivot protuberances 22 are placed in the notches 111, the pivot axles 30 are inserted into the axle holes 112 of the pivot seats 11 and the axle holes 211 of the pivot seats 21, so that the top lid 20 divided into two halves can be pivotably and liftably provided on the storage bin 10.

Figure 4:
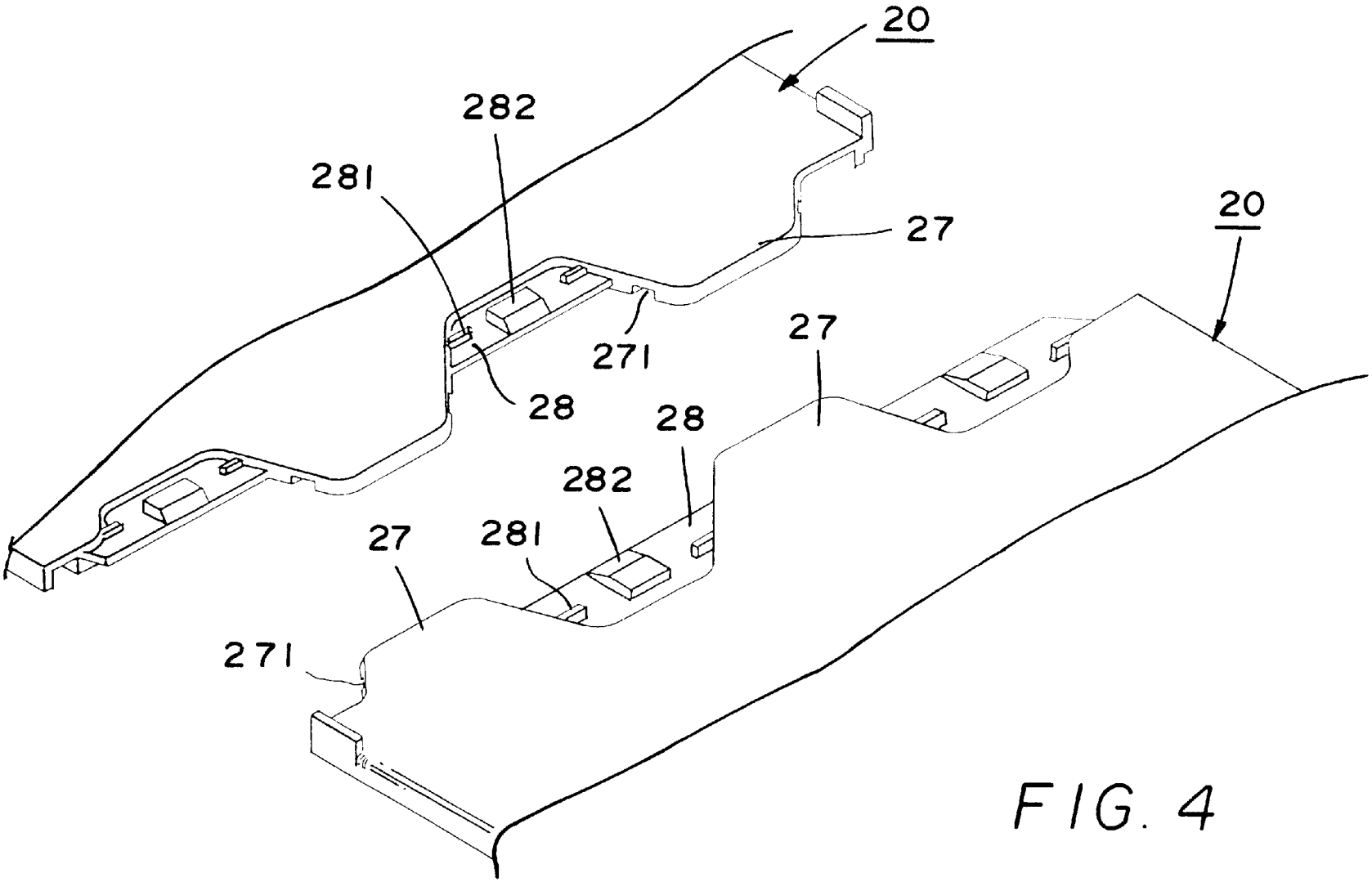
FIG. 4 is a schematic perspective view showing the two half-lids of the present invention are cross connected with each other.
Figure 5:
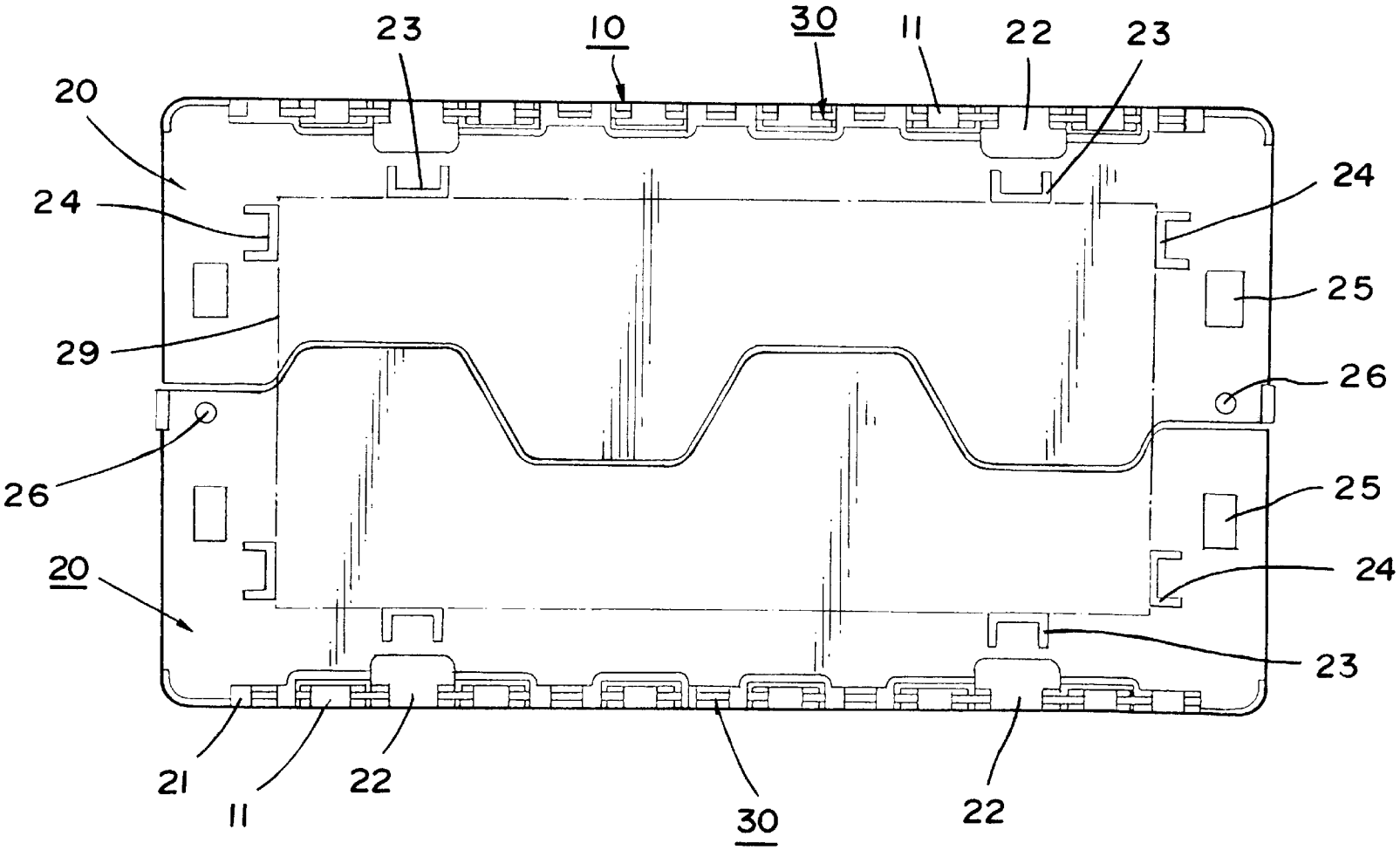
FIG. 5 is a top view showing the two half-lids of the present invention are cross connected with each other.
Figure 6:
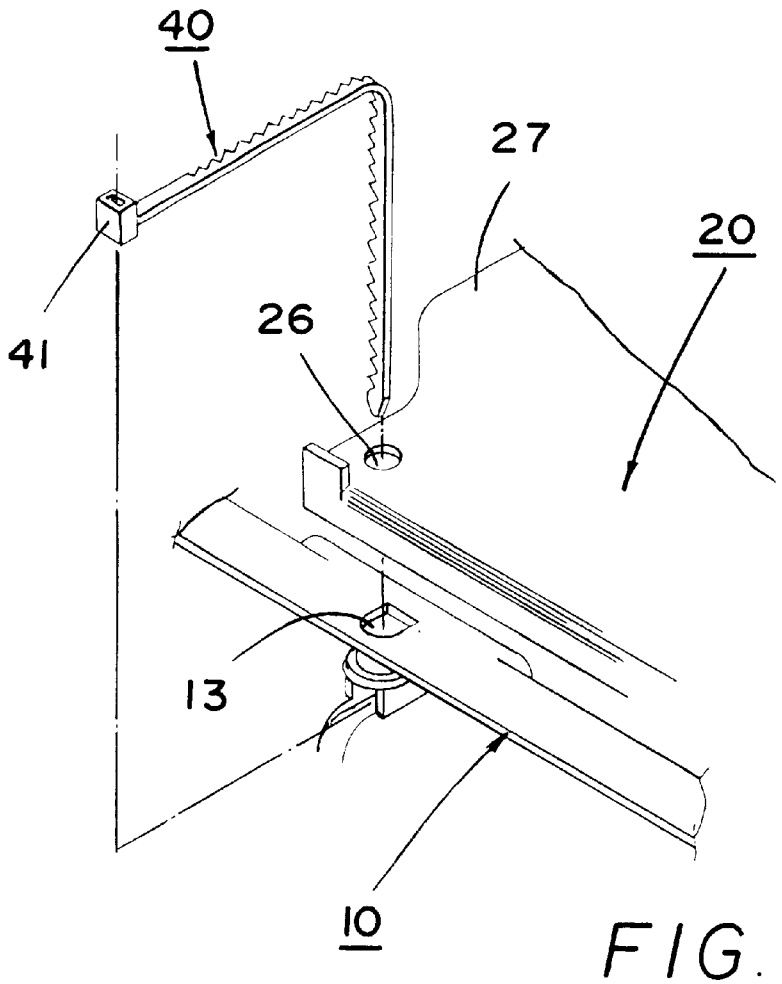
FIG. 6 is a schematic perspective view showing buckling of a belt through a round hole on the top lid and a through hole on the storage bin of the present invention.
Figure 7:
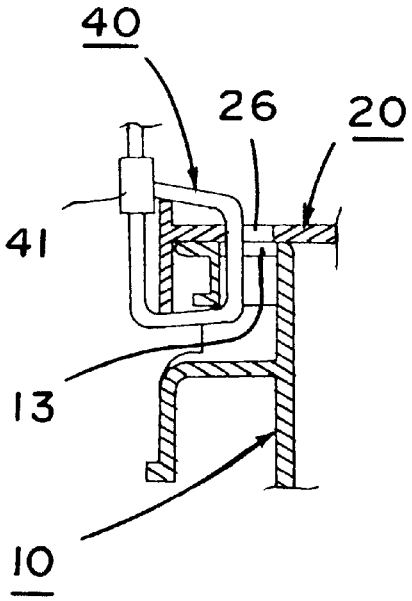
FIG. 7 is a sectional view showing buckling of the belt through the round hole on the top lid and the through hole on the storage bin of the present invention.
Figure 10:
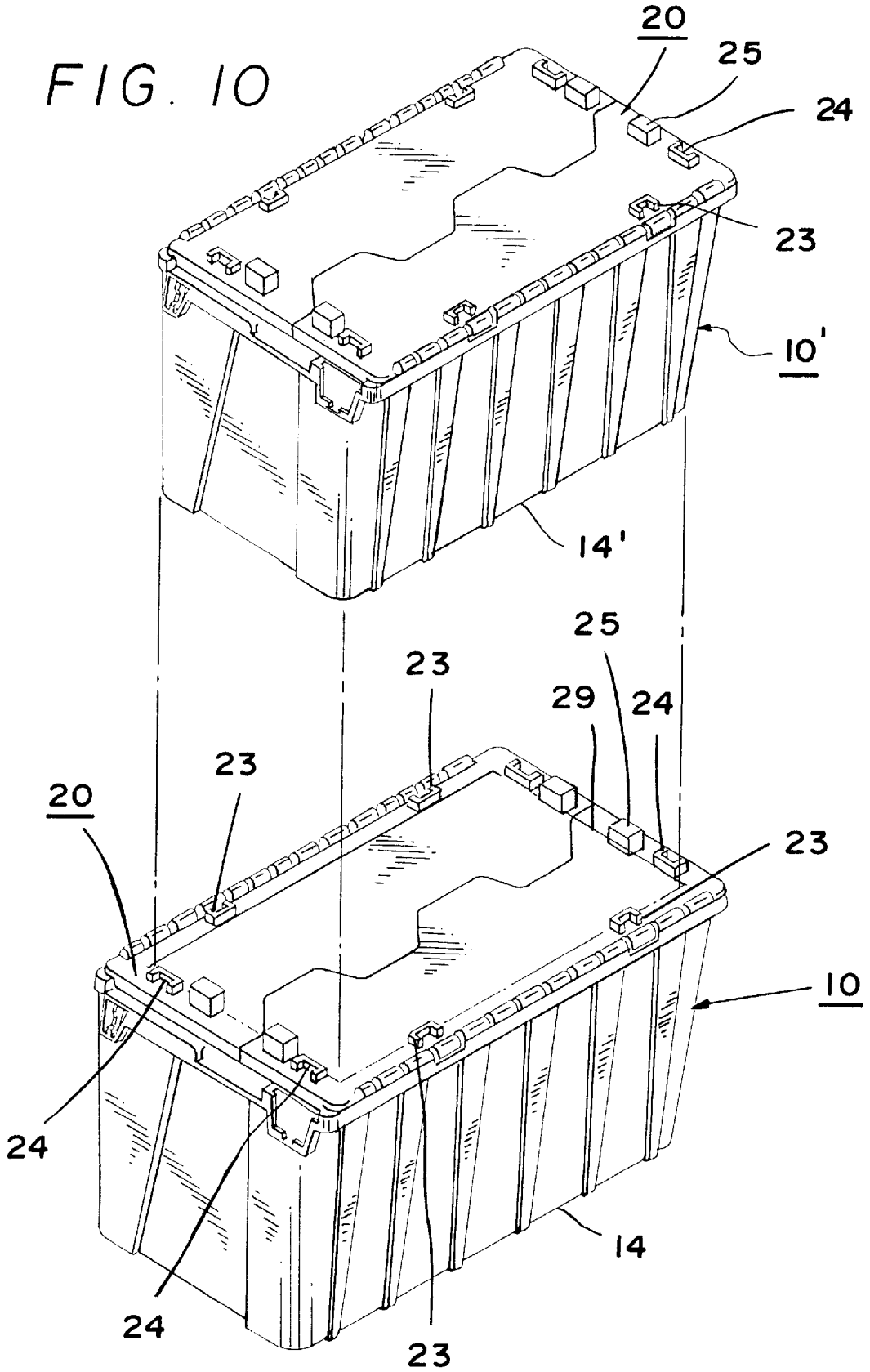
FIG. 10 is a perspective view of the storage bins of the present invention before stacking.

Referring to FIGS. 4 and 5, when the two halves of the top lid 20 on the storage bin 10 are closed and cross connected, the protruding engaging portions 27 of the top lid 20 lap over the recessed engaging portions 28, while the engaging grooves 271 on the bottom of the protruding engaging portions 27 are engaged with the engaging strips 281 and engaging blocks 282 of the recessed engaging portions 28, so that the two halves of the top lid 20 are mutually cross connected, the connecting line thereof is in the form of a zigzag line, the connection is very tight, and after connection, the transverse limiting protrusions 23 and the longitudinal limiting protrusions 24 of the top lid 20 form a limiting area 29 of which the length and the width exactly equal to the length and width of the bottom 14 of the storage bin 10, therefore, when another storage bin 10' is stacked on the storage bin 10, the bottom 14 of the storage bin 10' is placed exactly in a limiting area 29 formed on the top lid 20 of the storage bin 10 (as shown in FIG. 10) to be prevented from moving and shaking, thereby stability of stacking of the storage bins 10, 10' can be secured; when the top lid 20 covers the storage bin 10 (as shown in FIGS. 6 and 7), a plurality of round holes 26 on the top lid 20 are exactly located respectivly on a plurality of through holes 13 on the storage bin 10, a plurality of buckling belts 40 can be extended through the round holes 26 and the through holes 13, the heads of the buckling belts 40 are used to lock the buckling belts 40, the buckling belts 40 are normal buckling belts and are not further described in detail about their mode of locking herein, the top lid 20 is temporarily fixed on the storage bin 10 and can keep intactness of articles therein.

Figure 8:
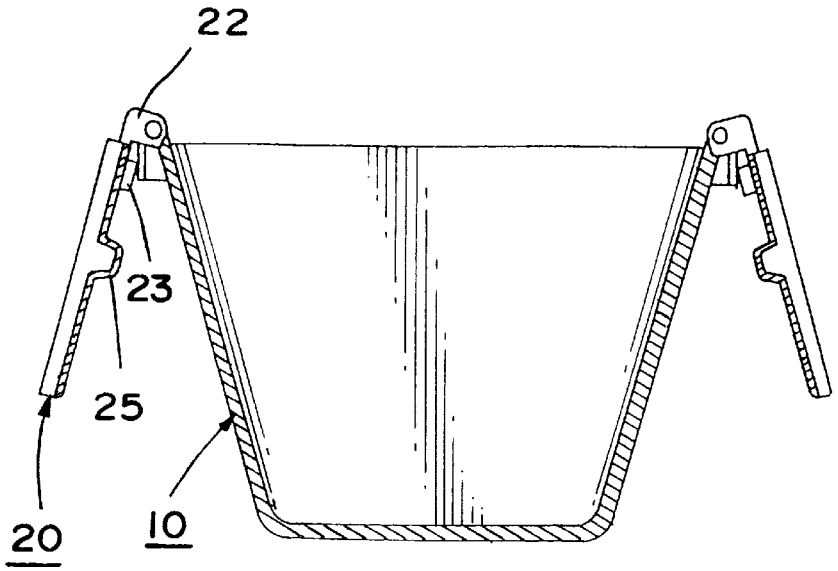
FIG. 8 is a sectional view of the storage bin of the present invention.
Figure 9:
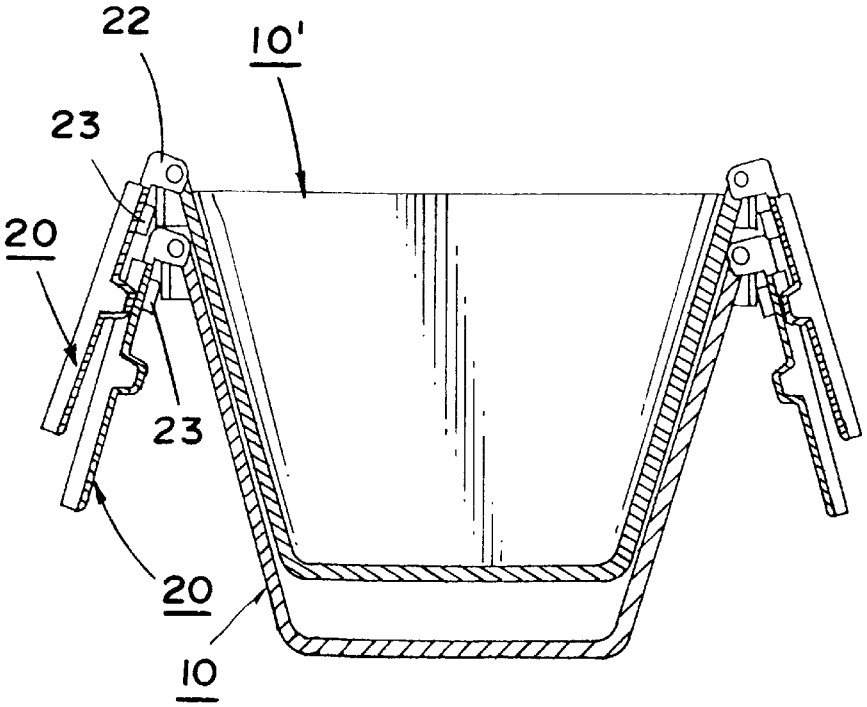
FIG. 9 is a sectional view of the storage bins of the present invention when in stacking.

Referring to FIGS. 8 and 9, when the top lid 20 on the storage bin 10 of the present invention is lifted for opening, the transverse limiting protrusions 23 of the top lid 20 abut exactly against the top external rim of the storage bin 10 to allow the top lid 20 to keep a suitable distance from the storage bin 10, when two storage bins 10, 10' are stacked together, they can get rid of impediment of the top lids 20 thereon, therefore, stacking of the storage bins 10, 10' is feasible.

Referring again to FIGS. 2 and 2A, the storage bin 10 of the present invention is provided on each of the opposite lateral sides thereof with a receiving groove 12 for an indicating tag, a notch 121 is provided on the bottom of the receiving groove 12, dust or water drops in the receiving groove 12 can be cleared and not impede insertion of the indicating tag in the receiving groove 12; the indicating tag can show the contents in the storage bin 10, therefore, workmen can classify the articles therein, it is not necessary to lift the top lid 20 to see what are in the storage bin 10, they can classify and arrange the articles very quick during transportation and storing, and the efficiency of work can be elevated.

In conclusion, the two halves of the top lid of the storage bin of the present invention are mutually cross connected with each other to increase tightness of sealing of the top lid against the storage bin, and to temporarily lock the top lid on the storage bin, the notch provided on the bottom of the receiving groove for the indicating tag of the storage bin can allow clearing of the dust or water drops in the receiving groove, thus insertion of the indicating tag in the receiving groove is expedient, workmen can distinguish the articles in the storage bin, the present invention thus is an excellent innovation.

Having thus described my invention, what I claim as new and desire to be secured by Letters Patent of the United States are:

1. An improved structure for a covered storage bin, being comprised of a storage bin, a top lid and two pivot axles, wherein:

said storage bin is provided on tops of two opposite lateral sides thereof with a plurality of first pivot seats which are provided each with an axle hole, a plurality of notches are provided each between every two of said pivot seats, said storage bin is provided with a through hole and a receiving groove, a notch is provided on the bottom of said receiving groove;

said top lid is divided into two halves and is provided on one side of each half with a plurality of second pivot seats, a plurality of pivot protuberances are provided between two of said second pivot seats at both ends of said side, said second pivot seats and said pivot protuberances are provided each with an axle hole, the other side of each half is provided with a plurality of protruding engaging portions and recessed engaging portions mutually alternately arranged, each of said protruding engaging portions is provided on the bottom thereof with an engaging groove, while each of said recessed engaging portions is provided on the top thereof with an engaging strip and an engaging block, said top lid is provided thereon near said second pivot seats with a plurality of transverse limiting protrusions, longitudinal limiting protrusions and a plurality of limiting blocks;

by providing the above stated members, wherein said two halves of said top lid are pivotably provided on said storage bin, said second pivot seats provided on one side of each half of said top lid are placed alternately relative to said first pivot seats, said pivot protuberances are placed in said notches, said pivot axles are inserted into said axle holes of said first pivot seats and said axle holes of said second pivot seats, so that said top lid is pivotably and liftably provided on said storage bin, when said two halves of said top lid are closed and cross connected, said protruding engaging portions of said top lid lap over said recessed engaging portions, while said engaging grooves on the bottom of said protruding engaging portions are engaged with said engaging strips and engaging blocks of said recessed engaging portions, so that said two halves of said top lid are mutually tightly cross connected on said storage bin.

2. An improved structure for a covered storage bin as in claim 1, wherein:

when said top lid covers said storage bin, a plurality of round holes on said top lid are exactly located respectivly on a plurality of through holes on said storage bin to allow a plurality of buckling belts to be extended through said round holes and said through holes and buckled, thus said top lid is temporarily fixed on said storage bin.

3. An improved structure for a covered storage bin as in claim 1, wherein:

said transverse limiting protrusions and longitudinal limiting protrusions of said top lid form a limiting area of which the length and the width exactly equal to the length and width of the bottom of said storage bin, therefore, when another storage bin is stacked on said storage bin, the bottom of said another storage bin is placed exactly in said limiting area, thereby stability of stacking of said storage bins can be secured against moving and shaking.

4. An improved structure for a covered storage bin as in claim 1, wherein:

when said top lid on said storage bin is lifted for opening, said transverse limiting protrusions of said top lid abut exactly against a top external rim of said storage bin to allow said top lid to keep a suitable distance from said storage bin, when two storage bins are stacked together, the upper one of said two storage bins is placed in the lower one thereof, said suitable distance between said upper storage bin and said top lid of said storage bin allows fit stacking of them over said lower storage bin with its top lid also in an opening state, therefore, stacking of said storage bins is feasible without impediment of their top lids respectively thereon.

5. An improved structure for a covered storage bin as in claim 1, wherein:

said storage bin is provided on each of the mutually opposite lateral sides thereof with a receiving groove for an indicating tag, the bottom of said receiving groove is provided with a notch, dust or water drops in said receiving groove can thus be cleared by said notch, and not deposit in said receiving groove to allow complete insertion of said indicating tag in said receiving groove.

* * * * *